US010013906B2

(12) United States Patent
Lee et al.

(10) Patent No.: US 10,013,906 B2
(45) Date of Patent: Jul. 3, 2018

(54) ORGANIC LIGHT EMITTING DIODE DISPLAY DEVICE

(71) Applicant: LG Display Co., Ltd., Seoul (KR)

(72) Inventors: Geun-Woo Lee, Seoul (KR); An-Su Kim, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 14 days.

(21) Appl. No.: 15/393,515

(22) Filed: Dec. 29, 2016

(65) Prior Publication Data

US 2017/0193877 A1 Jul. 6, 2017

(30) Foreign Application Priority Data

Dec. 31, 2015 (KR) ..... 10-2015-0191535

(51) Int. Cl.

| | |
|---|---|
| ***G09G 5/10*** | (2006.01) |
| ***G09G 3/20*** | (2006.01) |
| ***G09G 3/3233*** | (2016.01) |
| ***G09G 3/3291*** | (2016.01) |

(52) U.S. Cl.

CPC ..... *G09G 3/2003* (2013.01); *G09G 3/3233* (2013.01); *G09G 3/3291* (2013.01); *G09G 2310/027* (2013.01); *G09G 2310/0297* (2013.01); *G09G 2310/08* (2013.01); *G09G 2320/0295* (2013.01); *G09G 2320/0693* (2013.01); *G09G 2340/02* (2013.01); *G09G 2340/06* (2013.01); *G09G 2350/00* (2013.01); *G09G 2370/08* (2013.01); *G09G 2370/12* (2013.01)

(58) Field of Classification Search

CPC ..... G09G 3/20; G09G 3/2003; G09G 3/3233; G09G 3/3291; G09G 2310/027; G09G 2310/08; G09G 2350/00; G09G 2370/12

See application file for complete search history.

(56) References Cited

U.S. PATENT DOCUMENTS

| | | | | |
|---|---|---|---|---|
| 6,564,269 | B1 * | 5/2003 | Martin | G09G 5/006 348/E7.026 |
| 7,040,823 | B2 * | 5/2006 | Silverbrook | B41J 2/01 345/156 |
| 9,171,491 | B1 * | 10/2015 | Kwon | G09G 3/3648 |
| 2007/0035706 | A1 * | 2/2007 | Margulis | G03B 21/20 353/122 |

(Continued)

*Primary Examiner* — Joe H Cheng

(74) *Attorney, Agent, or Firm* — Morgan, Lewis & Bockius LLP

(57) ABSTRACT

An organic light emitting diode display device includes a display module having a display panel and a panel driver; a host system separated from the display module with a timing controller to control the panel driver; and an interface device between the host system and the display module. The interface device includes a cable between the host system and the display module, a transmission module to compress display data from the timing controller in an active period of each frame without compressing sensing data and recovery data supplied in a blank period of the frame and to transmit the compressed display data, the non-compressed sensing data and recovery data via the cable, and a reception module to decompress the compressed data transmitted via the cable, to supply the decompressed data to the panel driver, and to supply the non-compressed data to the panel driver without data processing.

6 Claims, 5 Drawing Sheets

(56) References Cited

U.S. PATENT DOCUMENTS

| | | | | |
|---|---|---|---|---|
| 2011/0243465 | A1* | 10/2011 | Lin | G09G 3/20 382/233 |
| 2012/0062593 | A1* | 3/2012 | Kojima | G06F 3/0488 345/629 |
| 2015/0242049 | A1* | 8/2015 | Tsukahara | G06F 3/0488 345/173 |
| 2017/0124949 | A1* | 5/2017 | Lee | G09G 3/3233 |

* cited by examiner

ORGANIC LIGHT EMITTING DIODE DISPLAY DEVICE

This application claims the benefit of Korean Patent Application No. 10-2015-0191535, filed on Dec. 31, 2015, which is hereby incorporated by reference.

BACKGROUND

Field of the Invention

The present invention relates to a display device, and more particularly, to a display device including an interface device that effectively transmits data technology during communication between a display module and an external circuit.

Discussion of the Related Art

Examples of flat display devices recently highlighted as display devices to display images using digital data include a liquid crystal display (LCD) using liquid crystals, and an organic light emitting diode (OLED) display using OLEDs. An organic light emitting diode (OLED) display device is a self-luminous device in which an organic light emitting layer emits light through re-combination of electrons and holes. Because the OLED display device exhibits high luminance, uses a low drive voltage, and has a slim profile, the OLED display device is expected to be a next-generation display device.

Such an OLED display device includes a plurality of pixels, each of which includes an OLED having an anode, a cathode, and an organic light emitting layer interposed between the anode and the cathode, and a pixel circuit for independently driving the OLED. The pixel circuit includes a switching thin film transistor (TFT) for supplying a data voltage to a storage capacitor, a drive TFT for controlling drive current in accordance with a drive voltage charged in the storage capacitor and supplying the controlled drive current to the OLED. The OLED generates light having a light amount proportional to the amount of the drive current.

In related art OLED display devices, however, a non-uniformity of luminance may occur as a result of deviations in driving characteristics (e.g., threshold voltage and mobility) of drive TFTs among pixels due to process deviation and passage of time. To solve such a problem, OLED display devices use an external compensation method for sensing driving characteristics of each pixel, and compensating data to be supplied to the pixel using the sensed value.

OLED display devices are applicable to various products, such as portable terminals, TV sets, flexible displays, and transparent displays. Recent advances in OLED display devices have focused on reducing thickness for application to a paper display or a wallpaper display.

To reduce thickness of a display module in an OLED display device, a scheme to externally separate a part of circuit configurations mounted in the display module should be taken into consideration. In this case, an encrypted transmission system is required to protect contents during communication between the display module and the separated circuit configuration.

In particular, when an interface using the encrypted transmission system is used, a scheme for transmitting sensing data required for external compensation of the OLED display device without data loss should also be taken into consideration. In addition, because the transmission cable between the externally separated circuit and the display module is externally exposed, a scheme for reducing the thickness of the cable should be taken into consideration for an improved design.

SUMMARY

Accordingly, the present invention is directed to an organic light emitting diode (OLED) display device that substantially obviates one or more problems due to limitations and disadvantages of the related art.

An object of the present invention is to provide an organic light emitting diode display device capable of externally separating a control module from a display module, thereby achieving a thin profile of the display module.

Another object of the present invention is to provide an OLED display device including an interface device capable of efficiently transmitting data through selective use of a compression technology during communication between a display module and an externally separated control module to achieve a slim display module.

Additional features and advantages of the invention will be set forth in part in the description that follows, and in part will be apparent from the description, or may be learned by practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, an organic light emitting diode (OLED) display device comprises a display module including a display panel and a panel driver configured to drive the display panel; a host system separated from the display module, the host system including a timing controller configured to control the panel driver; and an interface device configured to communicate between the host system and the display module, the interface device including: a cable connected between the host system and the display module, a transmission module configured to compress display data supplied from the timing controller in an active period of each frame without compressing sensing data and recovery data supplied in a blank period of the frame, and to transmit the compressed display data and the non-compressed sensing data and recovery data via the cable, and a reception module configured to decompress the compressed data transmitted via the cable, to supply the decompressed data to the panel driver, and to supply the non-compressed data to the panel driver without data processing.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principles of the invention. In the drawings.

DETAILED DESCRIPTION

Reference will now be made in detail to embodiments of the present invention, examples of which are illustrated in the accompanying drawings.

Figure 1:
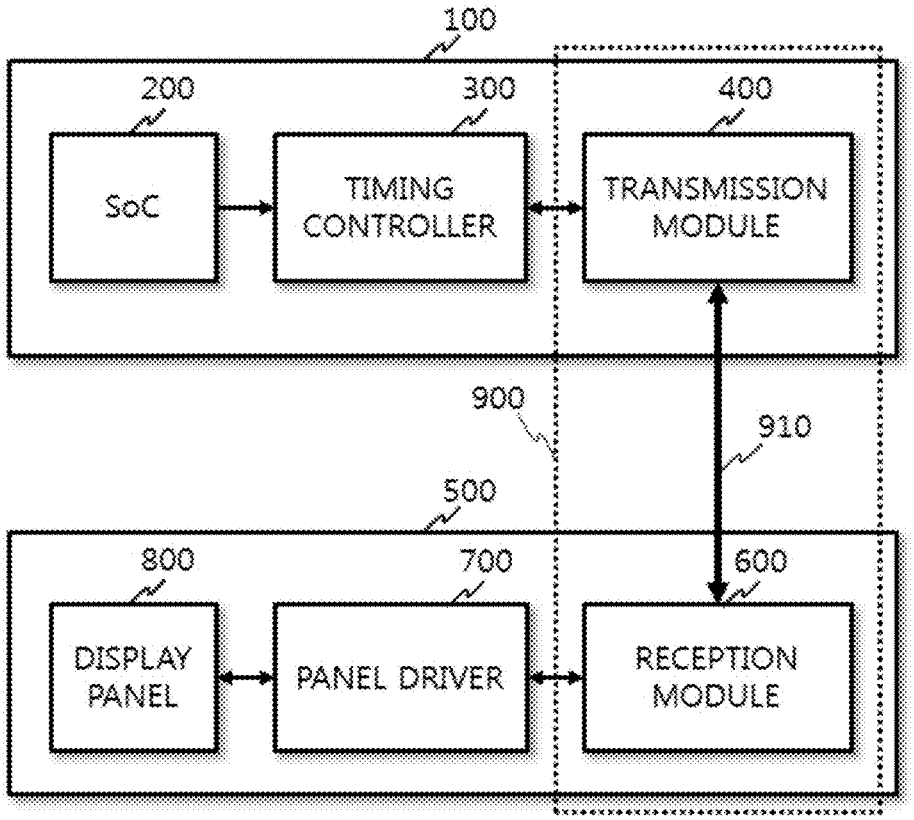
FIG. 1 is a block diagram illustrating a configuration of an organic light emitting diode (OLED) display device according to an example embodiment of the present invention.

FIG. 1 is a block diagram illustrating a configuration of an organic light emitting diode (OLED) display device according to an example embodiment of the present invention.

As shown in FIG. 1, the OLED device may include a host system 100 and a display module 500. The display module 500 includes a reception module 600, a panel driver 700, and a display panel 800. The host system 100 includes a system-on-chip (SoC) 200, a timing controller 300, and a transmission module 400. To achieve a slim display module 500, a control printed circuit board (not shown) including the timing controller 300 is separated from the display module 500, and is built in the host system 100.

For content protection during communication between the display module 500 and the externally separated timing controller 300, an interface device 900 using an encrypted transmission system is applied to the OLED display device. In accordance with an example embodiment of the present invention, the interface device 900 may include the transmission module of the host system 100, and the reception module 600 of the display module 500 connected to the transmission module 400 via a cable 910. The transmission module 400 and reception module 600 may be referred to as a "SerDes Tx IC" having an integrated circuit structure and a "SerDes Rx IC" having an integrated circuit structure, respectively. The host system 100 may be any one of systems of portable terminals, for example, a computer, a TV system, a set-top box, a tablet, and a portable phone.

The SoC 200 includes a scaler (or the like) to convert video data into data having a resolution format suitable for display on the display module 500, and then, to output the converted data to the timing controller 300. The SoC 200 generates a plurality of timing signals including a clock CLK, a data enable signal DE, a vertical synchronization signal Vsync, a horizontal synchronization signal Hsync, etc.

The SoC 200 and timing controller 300 may communicate with each other, using any one of various interfaces. For example, the SoC 200 and timing controller 300 may transmit and receive data and clocks by use of a low voltage differential signaling (LVDS) interface using LVDS. In this case, the SoC 200 includes an LVDS transmitter (not shown) installed at an output stage of the SoC 200, whereas the timing controller 300 includes an LVDS transmitter (not shown) installed at an input stage of the timing controller 300.

The timing controller 300 converts data of 3 colors (red, green, and blue (RGB)) received from the SoC 200 into data of 4 colors (white, red, green, and blue (WRGB)), using a predetermined RGB-to-WRGB conversion method. The timing controller 300 processes the WRGB data through various image processing procedures, such as power consumption reduction, picture quality compensation, external compensation, and degradation compensation, and then outputs the resultant data.

For example, when using power consumption reduction, the timing controller 300 analyzes an input image, to determine a peak luminance of the input image in accordance with information as to image characteristics, such as average picture level (APL), and adjusts a gamma high-level voltage EVDD in accordance with the determined peak luminance. The adjusted gamma high-level voltage EVDD is then supplied to the display module 500 through the interface device 900.

For external compensation for deviations among pixels, the timing controller 300 senses driving characteristics (threshold voltage Vth and mobility of drive TFT, Vth of OLED, etc.) of each pixel in the display panel 800 through the interface device 900 and panel driver 700 in every desired sensing period, such as a power-on time, a vertical blank period of each vertical synchronization signal, or a power-off time.

That is, in each sensing period, the timing controller 300 supplies sensing data (data included in video data) to pixels corresponding to the sensing period through the interface device 900 and panel driver 700 to drive the pixels. The panel driver 700 senses a voltage reflecting driving characteristics of each driven pixel and converts the sensed value into a digital sensing value. The digital sensing value from the panel driver 700 is supplied to the timing controller 300 through the interface device 900.

The timing controller 300 processes the sensing value of each pixel, generates compensation values for compensating for driving deviations of pixels (mobility and Vth deviations of drive TFTs, Vth deviations of OLEDs, etc.), and stores the generated compensation values in a memory. The timing controller 300 compensates pixel data to be supplied to the pixels using the compensation values stored in the memory, and then, outputs the compensated pixel data.

The timing controller 300 generates data control signals and gate control signals for controlling driving timing of the panel driver 700 using timing signals received from the SoC 200 and outputs the generated control signals to the panel driver 700 through the interface device 900. The data control signals may include a source start pulse, a source sampling clock, and a source output enable signal for controlling driving timing of a data driver. The gate control signals may include a gate start pulse, a gate shift clock, and a gate output enable signal for controlling driving timing of a gate driver. The timing controller 300 may transmit the vertical synchronization signal Vsync to the transmission module 400 together with the above-described control signals.

The interface device 900 may use a high definition multimedia interface (HDMI) supporting an encryption algorithm for high-bandwidth digital content protection (HDCP) capable of preventing copying of content to protect externally exposed content. The HDMI uses a transition minimized differential signaling (TMDS) communication scheme, which is a digital transmission protocol.

The transmission module 400 encrypts pixel data received from the timing controller 300 using the HDCP encryption algorithm, and then, converts the encrypted pixel data into a transmission packet together with control information, etc. A differential signal corresponding to the transmission packet is transmitted from the transmission module 400 to the reception module 600 in an in-series manner via the cable 910. The reception module 600 recovers the transmission packet from the received differential signal, and recovers the pixel data, control information, etc. using an HDCP recovery algorithm. The recovered data is then output from the reception module 600 to the panel driver 700.

In particular, the transmission module 400 compresses pixel data for display received from the timing controller 300, encrypts the compressed data, and transmits the encrypted data. Accordingly, the number of data transmission lines, e.g., a bandwidth, can be reduced. On the other hand, the transmission module 400 encrypts sensing data received from the timing controller 300 without compression, and transmits the encrypted sensing data. Accordingly, compression loss of the sensing data can be prevented. In addition, the transmission module 400 encrypts recovery data received after reception of the sensing data without compression, and transmits the encrypted recovery data. In this case, the transmission module 400 time-divides 4-color (RGBW) data supplied as the recovery data, and transmits the time-divided data. Accordingly, the recovery data can be transmitted through the same transmission line as the sensing data, which corresponds to one-color data of the 4-color data. Thus, the number of transmission lines can be reduced as compared to the case in which 4-color data as recovery data are simultaneously transmitted through respective transmission lines.

Figure 2:
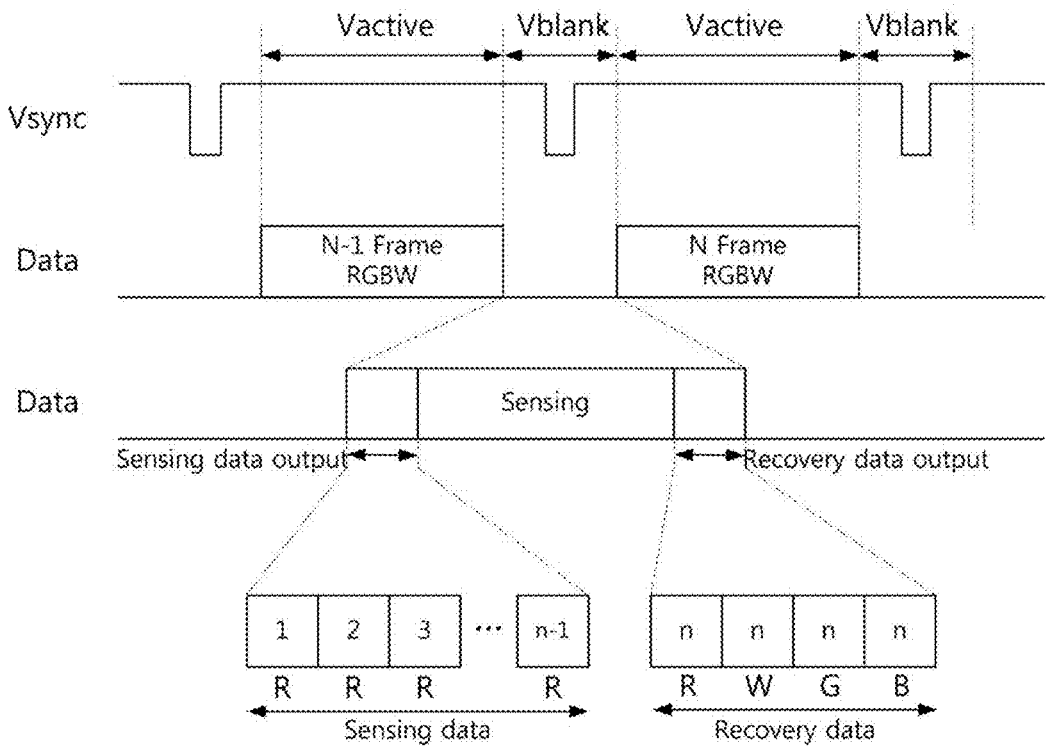
FIG. 2 is a timing diagram illustrating data transmission in an interface device according to an example embodiment of the present invention.

With reference to FIG. 2, in each active period Vactive of the vertical synchronization signal Vsync from the timing controller 200, the transmission module 400 receives RGBW data for display of a frame corresponding to the active period Vactive, and transmits the received RGBW data for display after compression and encryption. In each blank period of the vertical synchronization signal Vsync from the timing controller 300, the transmission module 400 receives sensing data and recovery data, encrypts the received data without compression, and transmits the encrypted data. The recovery data is supplied to a sub-pixel, which operates in a sensing mode in response to sensing data supplied thereto, to recover the driving state of the sub-pixel (the voltage states of the gate and source electrodes of the drive transistor) to a display mode. The timing controller 300 supplies, as recovery data, 4-color data for display corresponding to a final horizontal line, which has been supplied in a previous frame period N−1.

Because only sub-pixels of one color in one horizontal line are sensed in each blank period Vblank, only one-color data of the 4-color data for each pixel is supplied as sensing data. On the other hand, as recovery data is supplied after supply of the sensing data, all the 4-color data for display of a previous frame are supplied. The transmission module 400 time-divides 4-color recovery data prior to encryption thereof, sequentially encrypts the time-divided 4-color recovery data, and sequentially transmits the encrypted data to carry out transmission of the 4-color recovery data using the transmission path used to transmit only one-color data of 4-color data of each pixel. Accordingly, a bandwidth can be reduced as compared to the case in which 4-color recovery data are simultaneously transmitted.

The timing controller 300 and transmission module 400 transmit and receive data using any one of various interfaces. The reception module 600 and panel driver 700 also transmit and receive data, using any one of various interfaces.

For example, an LVDS interface, an embedded point-to-point interface (EPI) known as a high speed serial interface, or a V-by-one (V×1) interface may be used. For application of the EPI or V×1 interface, the transmitter (not shown) installed at the output stage of the timing controller 300 or the output stage of the reception module 600 converts pixel data and control information including various control data into a transmission packet having a serial format while including clocks. The transmitter then transmits the transmission packet in the form of a differential signal through a pair of transmission lines. The receiver (not shown) installed at the input stage of the transmission module 400 or the input stage of the data driver included in the panel driver 700 recovers clocks, control information, and pixel data from the received transmission packet. The transmission packet includes a control packet including a clock training pattern for clock locking of the receiver, an alignment training pattern, clocks, and control information in the form of serial data, and a data packet including clocks and pixel data in the form of serial data.

Figure 3:
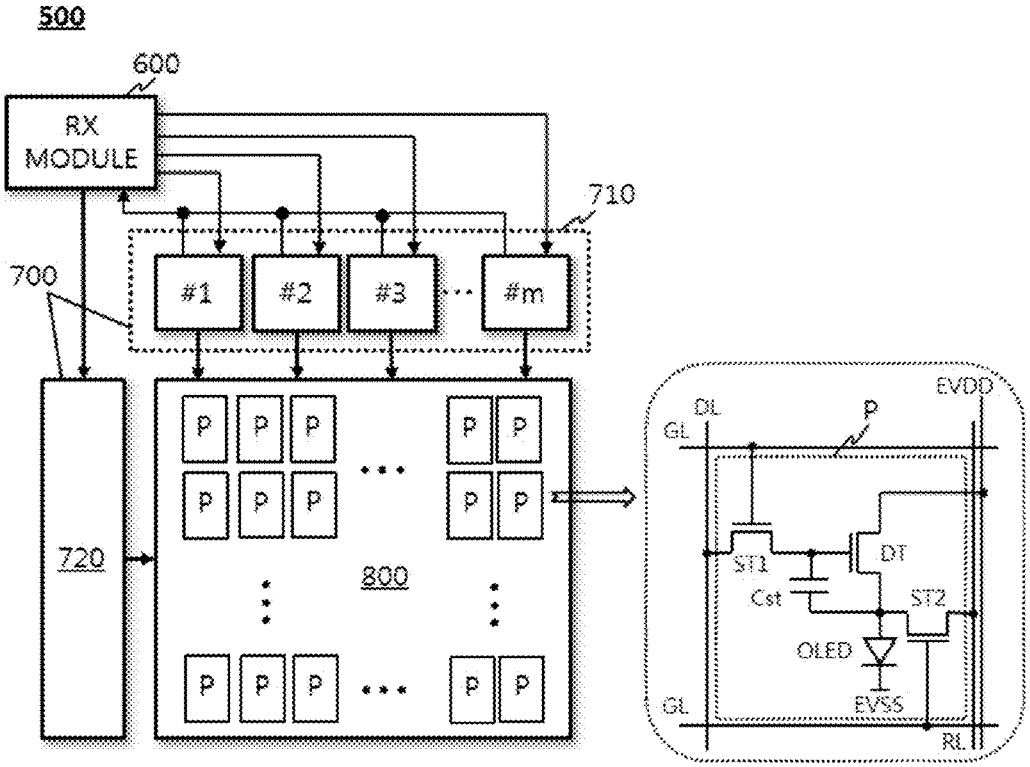
FIG. 3 is a diagram illustrating a configuration of an example display module for a display device as illustrated in FIG. 1.

FIG. 3 is a block diagram illustrating an example configuration of the display module 500 in a display device of FIG. 1.

As shown in FIG. 3, the display module 500 may include a panel driving unit 700 including the reception (RX) module 600, a data driver 710, and a gate driver 720, and the display panel 800. The reception module 600 performs data processing required for the differential signal transmitted from the transmission module 400 via the cable 910, thereby recovering pixel data and control information, as described above. The reception module 600 converts pixel data and data control information into an EPI packet, and transmits the EPI packet to a plurality of data ICs #1 to #m constituting the data driver 710. The reception module 600 transmits a gate control signal to the gate driver 720. The gate control signal may be supplied to the gate driver 720 after being level-shifted while passing through a level shifter included in a power IC (not shown).

Each of the data ICs #1 to #m constituting the data driver 710 recovers clocks, control information, and pixel data from the EPI packet transmitted from the reception module 600, converts the pixel data into an analog data signal, and then supplies the analog data signal to corresponding ones of data lines DL included in the display panel 800. Each of the data ICs #1 to #m sub-divides a set of reference gamma voltages supplied from a gamma voltage generator (not shown) separately provided at the outside into grayscale voltages respectively corresponding to grayscale values of pixel data. Each of the data ICs #1 to #m is driven in accordance with a data control signal, and converts digital data into an analog data signal using the sub-divided grayscale voltages, and supplies the analog data signal to the corresponding data lines DL of the display panel 800. Each of the data ICs #1 to #m converts sensing pixel data supplied through the reception module 600 in each sensing period into an analog data signal, supplies the analog data signal to the corresponding pixel P, and senses a voltage according to pixel current reflecting driving characteristics of the corresponding pixel P. Each of the data ICs #1 to #m converts the sensed voltage into a digital sensing value, and supplies a differential signal corresponding to the digital sensing value to the timing controller 300 via the interface device 900.

Each of the data ICs #1 to #m may be mounted on a circuit film, such as a tape carrier package (TCP), a chip-on-film (COF), a flexible printed circuit (FPC) or the like, and may then be attached to the display panel 800 in a tape automated bonding (TAB) manner or may be mounted on the display panel 800 in a chip-on-glass (COG) manner.

The gate driver 720 drives a plurality of gate lines GL included in the display panel 800 in response to gate control signals supplied from the reception module 600. In response to the gate control signals, the gate driver 720 supplies a scan pulse corresponding to a gate-on voltage to each gate line in a scan period corresponding to the gate line, and supplies a gate-off voltage to the gate line in the remaining periods. The gate driver 720 may include at least one gate IC. In this case, the gate driver 720 may be mounted on a circuit film, such as a TCP, a COF, or an FPC, and may then be attached to the display panel 800 in a TAB manner or may be mounted on the display panel 800 in a COG manner. Otherwise, the gate driver 720 may be formed at a TFT substrate, together with a TFT array constituting a pixel array and, as such, may be installed at a non-display area of the display panel 800 in the form of a gate-in-panel (GIP) type.

The display panel 800 displays an image through a pixel array in which pixels P are arranged in a matrix form. The pixel array includes R/G/B/W pixels. Each pixel P includes an OLED connected between a high-level voltage source (EVDD) line and a low-level voltage source (EVSS) line, and a pixel circuit for independently driving the OLED. The pixel circuit includes a first switching TFT ST1, a second switching TFT ST2, a drive TFT DT, and a storage capacitor Cst. The configuration of the pixel circuit may be diverse and, as such, is not limited to the configuration of FIG. 2.

The OLED includes an anode connected to the drive TFT DT, a cathode connected to the EVSS line, and a light emitting layer arranged between the anode and the cathode. In accordance with this configuration, the OLED generates light in an amount proportional to the amount of current supplied from the drive TFT DT.

The first switching TFT ST1 is driven by a gate signal supplied from one gate line GL, and supplies a data signal from a corresponding one of the data lines DL to a gate node of the drive TFT DT. On the other hand, the second switching TFT ST2 is driven by a gate signal supplied from another gate line GL, and supplies a reference voltage from a reference line RL to a source node of the drive TFT DT. The second switching TFT ST2 is also used as a path for outputting current from the drive TFT DT to the reference line RL in a sensing period.

The storage capacitor Cst, which is connected between the gate and source nodes of the drive TFTs DT, is charged with a differential voltage between the data voltage supplied to the gate node through the first switching TFT ST1 and the reference voltage supplied to the source node through the second switching TFT ST2, and supplies the differential voltage as a drive voltage of the drive TFT DT. The drive TFT DT controls current supplied from the high-level voltage source EVDD in accordance with the drive voltage supplied from the storage capacitor Cst and, as such, supplies current proportional to the drive voltage to the OLED which, in turn, emits light.

Figure 4:
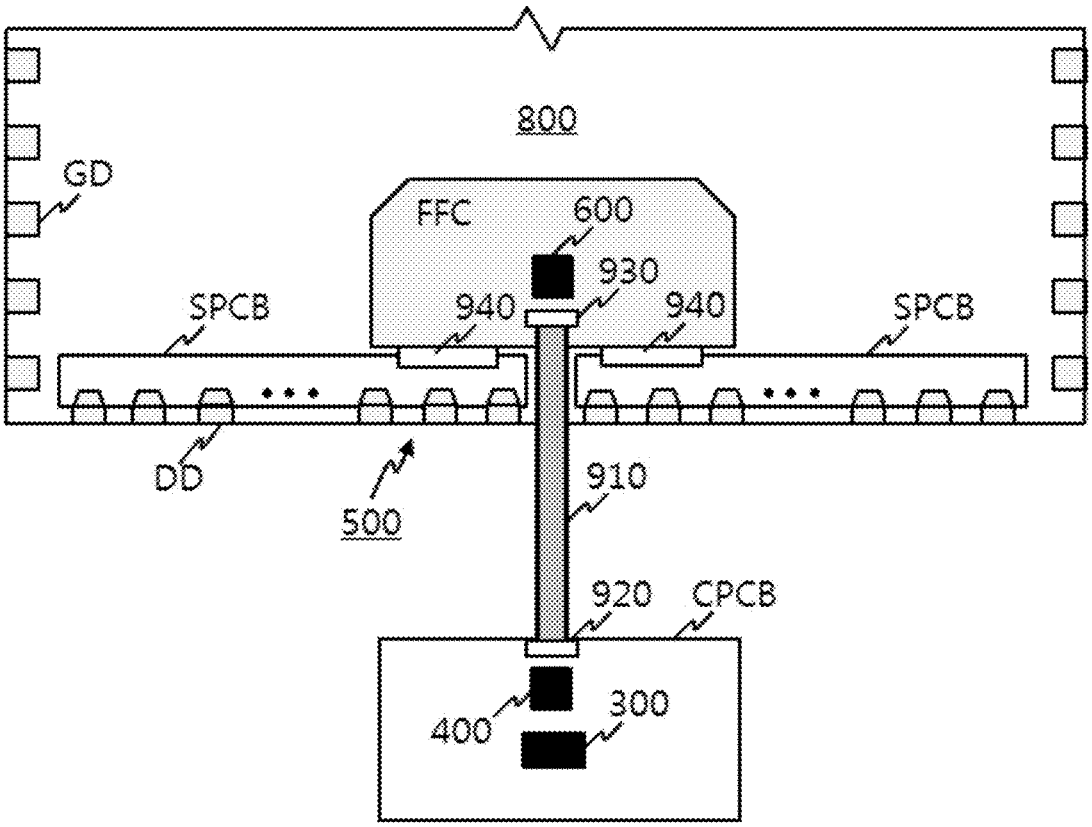
FIG. 4 is a diagram illustrating a slim configuration of the OLED display device according to an example embodiment of the present invention.

FIG. 4 is a view illustrating a structure of the OLED display device having a slim profile in accordance with an example embodiment of the present invention.

As illustrated in FIG. 4, the control printed circuit board (CPCB), on which the timing controller 300 is mounted, may be externally separated from the display module 500, and is connected to a flat flexible cable (FFC) included in the display module 500 by the cable 910. The CPCB is built in the above-described host system. The above-described system-on-chip (SoC) may also be mounted on the CPCB. The power IC, etc. may further be mounted on the FFC of the display module 500.

For content protection, the above-described transmission module 400, e.g., a SerDes Tx IC, is mounted on the CPCB, and the above-described reception module 600, namely, a SerDes Rx IC, is mounted on the FFC. The transmission module 400 and reception module 600 communicate with each other through the cable 910 connected between a connector 920 of the CPCB and a connector 930 of the FFC in accordance with an HDMI transmission protocol.

The data drivers DD to drive the data lines of the display panel 800 are connected to the display panel 800. The data drivers DD are connected to a plurality of source printed circuit boards (SPCBs) in a divided manner. Each data driver DD may be constituted by a COF, on which a data IC is mounted. The SPCBs are connected to the FFC via a connector 940.

The gate drivers GD are connected to opposite lateral sides of the display panel 800 to drive the gate lines at the opposite sides of the display panel 800. Each gate driver GD may be constituted by a COF, on which a gate IC is mounted.

Thus, in the OLED display device according to the illustrated example, a slim display module 500 can be achieved in accordance with external separation of the CPCB and, as such, the OLED display device may be applied to a wallpaper display or the like.

Figure 5:
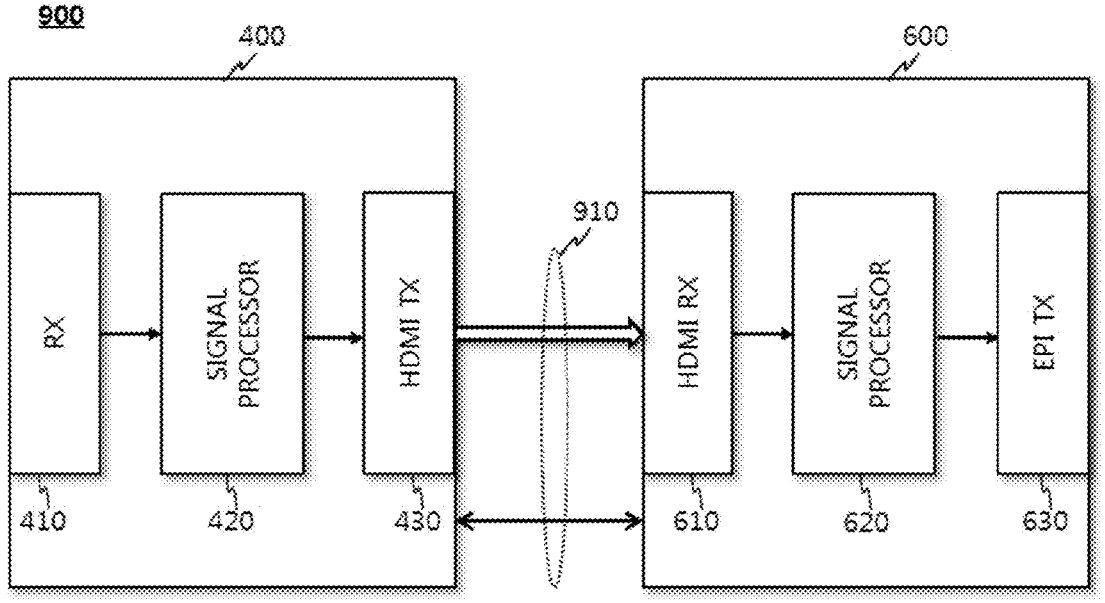
FIG. 5 is a block diagram illustrating an internal configuration of the interface device according to an example embodiment of the present invention.

FIG. 5 is a block diagram illustrating a configuration of the interface device according to an example embodiment of the present invention.

The transmission module 400 includes a receiver (RX) 410, a signal processor 420, and an HDMI transmitter (TX) 430. The receiver 410 recovers clocks, pixel data and control information from an EPI or V×1 transmission packet corresponding to a differential signal transmitted from the timing controller 300, and outputs the recovered data.

The signal processor 420 divides data received from the receiver 410 into display data, sensing data, and recovery data, and separately performs signal processing of the display data, sensing data, and recovery data. The signal processor 420 may carry out division of the display data, sensing data, and recovery data, using control information received from the receiver 410. The control information represents the active period Vactive and blank period Vblank of each frame.

The signal processor 420 compresses pixel data for display supplied in the active period Vactive of each frame, encrypts the compressed data using an HDCP algorithm, and transmits the encrypted data. Accordingly, the number of data transmission lines, e.g., a bandwidth, can be reduced. On the other hand, the signal processor 420 encrypts sensing data supplied in the blank period Vblank of each frame using the HDCP algorithm without compression, and transmits the encrypted data. Accordingly, compression loss of the sensing data can be prevented. The signal processor 420 time-divides 4-color recovery data supplied in the blank period Vblank of each frame, sequentially encrypts the time-divided data, and sequentially transmits the encrypted data. Accordingly, the recovery data can be transmitted through the same transmission line as the sensing data, which corresponds to one-color data of the 4-color data. Thus, the number of transmission lines can be reduced as compared to the case in which 4-color data as recovery data are simultaneously transmitted through respective transmission lines. The HDMI transmitter 430 converts the encrypted data and control information supplied from the signal processor 420 in the form of a differential signal, and transmits the differential signal.

The reception module 600 includes an HDMI receiver (RX) 610, a signal processor 620, and an EPI transmitter (TX) 630. The HDMI receiver 610 converts the differential signal supplied from the HDMI transmitter 470 via the cable 910 into clocks, transmission data, and control information, and outputs the converted data to the signal processor 620.

The signal processor 620 recovers the transmission data received from the HDMI transmitter 430 using the HDCP algorithm, decompresses the compressed display data, and outputs the recovered data and decompressed data. On the other hand, the signal processor 620 outputs the non-compressed sensing data and recovery data without decompression.

The EPI transmitter 630 converts the display data, sensing data, recovery data, and control information output from the signal processor 620 into an EPI transmission packet, together with clocks, and transmits the EPI transmission packet to the data driver DD through the EPI transmitter 670 in the form of a differential signal.

The cable 910 connected between the transmission module 400 and the reception module 600 further includes an additional link. A sensing value supplied from the data driver 710 in the form of a differential signal is transmitted to the timing controller 300 via the interface device 900.

As apparent from the above description, in accordance with the interface device and method in the display device according to example embodiments of the present invention, sensing data can be efficiently transmitted in an alternating manner through a plurality of channels respectively using a plurality of vertical synchronization signals respectively processed to have non-overlapping blank periods such that transmission of the sensing data is carried out in an active period of one channel overlapping with a blank period of another channel.

Further, in accordance with the interface device of the display device according to example embodiments of the present invention, compression loss of sensing data can be prevented by transmitting display data in a compressed state while transmitting sensing data and recovery data without compression.

In addition, the interface device of the display device according to example embodiments of the present invention may use the bandwidth of the sensing data without variation, through time-divided transmission of the recovery data. Accordingly, an increase in bandwidth for transmission of the recovery data can be prevented.

As such, the OLED display device according to example embodiments of the present invention may not only externally separate the control module from the display module, but also may efficiently transmit sensing data for external compensation in spite of use of an encrypted transmission protocol for protection of externally exposed content, using the above-described interface device. Thus, a slim display module may be achieved. As such, the OLED display device may be applied to a wallpaper display or the like.

It will be apparent to those skilled in the art that various modifications and variations can be made in the organic light emitting diode display device of the present invention without departing from the spirit or scope of the invention. Thus, it is intended that the present invention cover the modifications and variations of this invention provided they come within the scope of the appended claims and their equivalents.

What is claimed is:

1. An organic light emitting diode (OLED) display device, comprising:

a display module including a display panel and a panel driver configured to drive the display panel;

a host system separated from the display module, the host system including a timing controller configured to control the panel driver; and an interface device configured to communicate between the host system and the display module, the interface device including:

a cable connected between the host system and the display module, a transmission module configured to compress display data supplied from the timing controller in an active period of each frame without compressing sensing data and recovery data supplied in a blank period of the frame, and to transmit the compressed display data and the non-compressed sensing data and recovery data via the cable, and a reception module configured to decompress the compressed data transmitted via the cable, to supply the decompressed data to the panel driver, and to supply the non-compressed data to the panel driver without data processing.

2. The OLED display device according to claim 1, wherein the transmission module is further configured to transmit sensing data corresponding to one-color data of 4-color data supplied from the timing controller, without compression, to time-divide 4-color recovery data supplied from the timing controller on a sub-pixel basis, and to sequentially transmit the time-divided 4-color recovery data without compression.

3. The OLED display device according to claim 2, wherein:

the transmission module is further configured to encrypt the compression data and the non-compressed data, and to transmit the encrypted data; and wherein the reception module is further configured to recover the transmitted data into the compression data and the non-compressed data.

4. The OLED display device according to claim 3, wherein, in the blank period, the panel driver is configured to drive a pixel of the display panel using the sensing data supplied via the interface device in association with the pixel, sense output characteristics of the driven pixel, and transmit a sensed value of the pixel to the timing controller via the interface device.

5. The OLED display device according to claim 3, wherein:

the transmission module has an integrated circuit (IC) structure, is mounted on a control printed circuit board, on which the timing controller is mounted, and is connected to the cable via a connector of the control printed circuit board; and wherein the reception module has an IC structure, is mounted on a flat flexible cable mounted on the display panel, and is connected to the cable via a connector of the flat flexible cable.

6. The OLED display device according to claim 1, wherein the transmission module is installed in the host system, and wherein the reception module is mounted on the display module.

* * * * *